United States Patent [19]

Groover et al.

[11] Patent Number: 4,729,480

[45] Date of Patent: Mar. 8, 1988

[54] EXPANDED CAPACITY VEND BASKET FOR A VENDING MACHINE

[75] Inventors: Phillip B. Groover, Woodstock, Ga.; Gunther Baumgartner, Herrieden; Josef Gress, Beckhofen, both of Fed. Rep. of Germany

[73] Assignee: The Coca-Cola Company, Atlanta, Ga.

[21] Appl. No.: 897,207

[22] Filed: Aug. 18, 1986

[51] Int. Cl.[4] ..... A47F 1/04

[52] U.S. Cl. ..... 211/59.2; 312/72

[58] Field of Search ..... 211/59.2, 59.3; 312/45, 312/72

[56] References Cited

U.S. PATENT DOCUMENTS

| | | | |
|---|---|---|---|
| 1,415,337 | 5/1922 | Grover . | |
| 1,951,239 | 3/1934 | Friel . | |
| 2,315,515 | 4/1943 | Gibson et al. . | |
| 2,353,496 | 11/1944 | Pease | 221/105 |
| 2,513,595 | 7/1950 | Stewart | 221/125 |
| 2,546,690 | 3/1951 | Gabrielsen | 194/225 |
| 2,562,015 | 7/1951 | Cattanach | 194/244 |
| 2,642,171 | 6/1953 | Hamann | 194/250 |
| 2,959,979 | 11/1960 | Newberry . | |
| 3,087,649 | 4/1963 | Leonard et al. . | |
| 3,110,417 | 11/1963 | Wingate et al. . | |
| 3,113,816 | 12/1963 | Hulsey | 312/72 |
| 3,362,582 | 1/1968 | Gasparini | 221/298 |
| 3,587,925 | 6/1971 | Keller | 312/45 X |
| 3,664,476 | 5/1972 | Mauro | 194/226 |
| 3,923,159 | 12/1975 | Taylor et al. | 211/59.2 |
| 4,235,351 | 11/1980 | Kolbl et al. | 221/92 |
| 4,347,952 | 9/1982 | Bookout | 221/129 |
| 4,485,937 | 12/1984 | Adams . | |
| 4,576,272 | 3/1986 | Morgan, Jr. et al. | 194/215 |

*Primary Examiner*—Robert W. Gibson, Jr.

*Attorney, Agent, or Firm*—Birch, Stewart, Kolasch & Birch

[57] ABSTRACT

A vend basket for a coin operated vending machine which includes a first roller whose axis is parallel to the rotational axis of rollable products, such as bottles or cans, and is set back from the front wall of the basket by a distance greater than the diameter of the rollable product but less than twice the diameter so that only one product can fit and pass between the front wall and roller. The roller is also spaced above the bottom wall of the basket so that two rows of products can fit and pass under the roller. A second roller whose rotational axis is also parallel to the rotational axis of the rollable products is located in front of the first roller adjacent the front wall directly above a dispensing lid. The distance between the first and second rollers is such that only one article at a time can pass therebetween to a cradle formed in the dispensing lid. Such a structure permits a greater number of movable products to be located in the basket. Furthermore, the rollers prevent the products from becoming jammed during a dispensing operation of the vending machine.

16 Claims, 5 Drawing Figures

EXPANDED CAPACITY VEND BASKET FOR A VENDING MACHINE

BACKGROUND OF THE INVENTION

The present invention relates to a refrigerated automatic vending machine for bottles or cans. More specifically, the present invention relates to an improvement in vend baskets therefor so as to expand their capacity while preventing the vended article from becoming jammed or misaligned as well as insuring that only one article at a time reaches the dispensing port.

Coin operated automatic vending machines for bottles and cans having one or more vend baskets which include a roll-off ramp which is inclined toward a pivoted dispensing lid at the front of a refrigerated chest or housing are well known. One such vending machine is described in U.S. Pat. No. 4,235,351, entitled, "Merchandise Dispensing Device For A Vending Machine", which issued to R. Kölbl, et al. on Nov. 25, 1980. One of the features disclosed in that patent is a sheet metal guide which is located directly above the sensing lid which forms a stop and insures that the articles do not jam or become misaligned and that only one article at a time reaches the dispensing device. Moreover, two or more rows of cylindrical articles are uniformly arranged on an inclined roll-off ramp which forms a continuous surface.

Furthermore, in U.S. Pat. No. 4,576,272, entitled, "Counter Top Or Wall Mounted Vending Machine", which issued to A. R. Morgan, Jr., et al. on Mar. 18, 1986, there is disclosed a coin operated vending machine for bottles and cans of a moderate capacity including a plurality of side-by-side vend chutes which feed the articles to be vended to a respective cradle type dispensing lid located on the front wall of the vending machine. Each vend chute, moreover, is configured in the form of a serpentine basket having a rearward slanting upper shelf and a forward slanting lower shelf which support cans in a multiple tiered arrangement. Cans are guided from the upper shelf to the lower shelf by means of a passagewawy adjacent a rear wall which has an upper curved portion. In the process of rolling to a dispensing lid, an empty space arises inevitably between the lower and upper ramps or shelves. Such an empty space is undesirable if a relatively high holding capacity of the basket is desired.

SUMMARY

Accordingly, it is the primary object of the present invention to provide an improvement in vend baskets for vending machines.

It is another object of the invention to expand the merchandise holding capacity of a moderate capacity vending machine.

It is a further object of the invention to provide an expanded capacity vend basket of a vending machine while preventing the jamming of the vended articles against each other when they are being dispensed.

The objects of the present invention are fulfilled by providing a vend basket for a coin operated vending machine for rollable products, such as bottles or cans, which includes a roll-off ramp or shelf which is inclined toward a cradle type dispensing lid located in the front wall of the vending machine. The vend basket further includes a first roller element whose rotational axis is parallel to the rotational axis of the rollable products and is set back from the front wall by a distance greater than the diameter of the product being vended but less than twice that diameter so that only one product can fit and pass between the front wall and the first roller. The first roller is additionally spaced a distance above the roll-off ramp so that two rows of stacked rollable products can fit and pass under the roller. Additionally, a second roller element whose rotational axis is also parallel to the rotational axis of the rollable products is located directly above the dispensing lid behind the front wall with the distance between it and the first recited roller being such that only one article at a time can pass therebetween to a cradle which forms an inner portion of the dispensing lid.

BRIEF DESCRIPTION OF THE DRAWINGS

The objects of the present invention and the attendant advantages thereof will become more readily apparent by reference to the following drawings wherein like numerals refer to like parts, and wherein.

DETAILED DESCRIPTION OF THE PREFERRED EMBODIMENT

Figure 1:
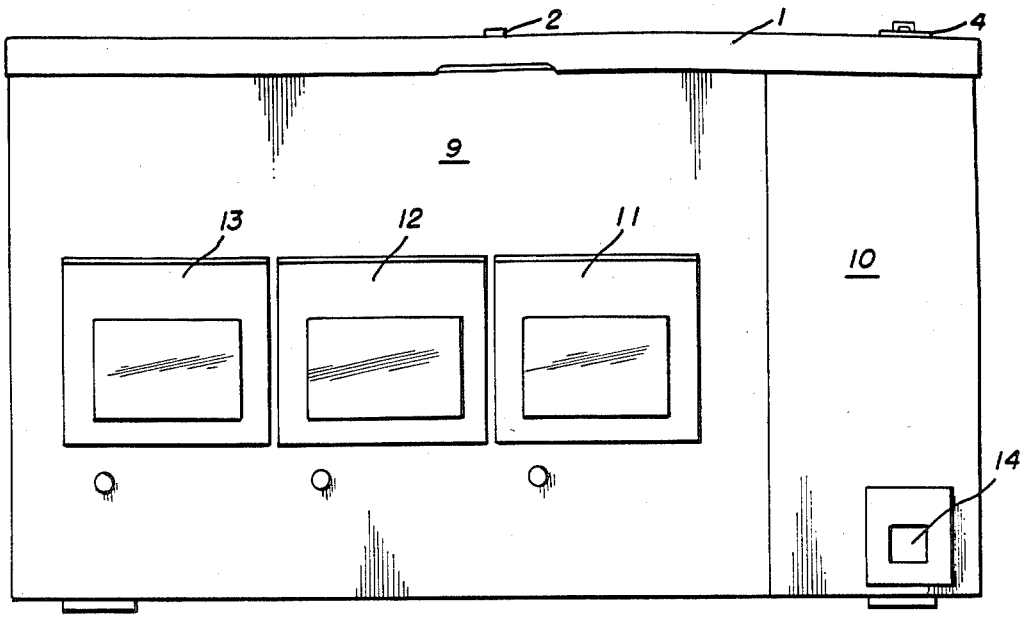
FIG. 1 is an elevational view of an automatic vending machine which is adapted to be utilized in connection with the present invention.
Figure 2:
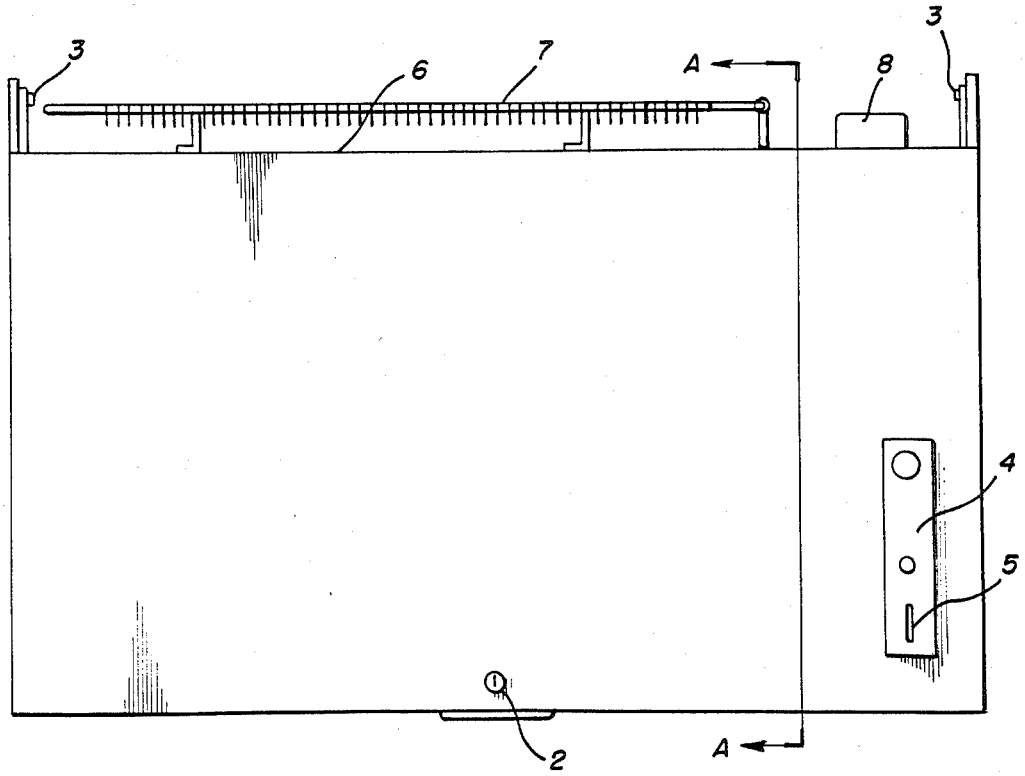
FIG. 2 is a top plan view of the vending machine of FIG. 1.

Referring now to the drawings and more particularly to FIGS. 1 and 2, there is disclosed an automatic vending machine of the type disclosed in the above referenced U.S. Pat. No. 4,576,272, Morgan, Jr., et al. The vending machine is configured in the form of a cabinet or chest whose top cover 1, after opening a lock, can be folded upward on hinged brackets 3. A cover plate 4 is disposed in the topcover 1 and is provided with a coin slot 5.

Externally on the back wall of the automatic vending machine there is mounted a condenser of a cooling unit. The compressor 8 of the cooling unit is located adjacent the condenser 7.

Figure 3:
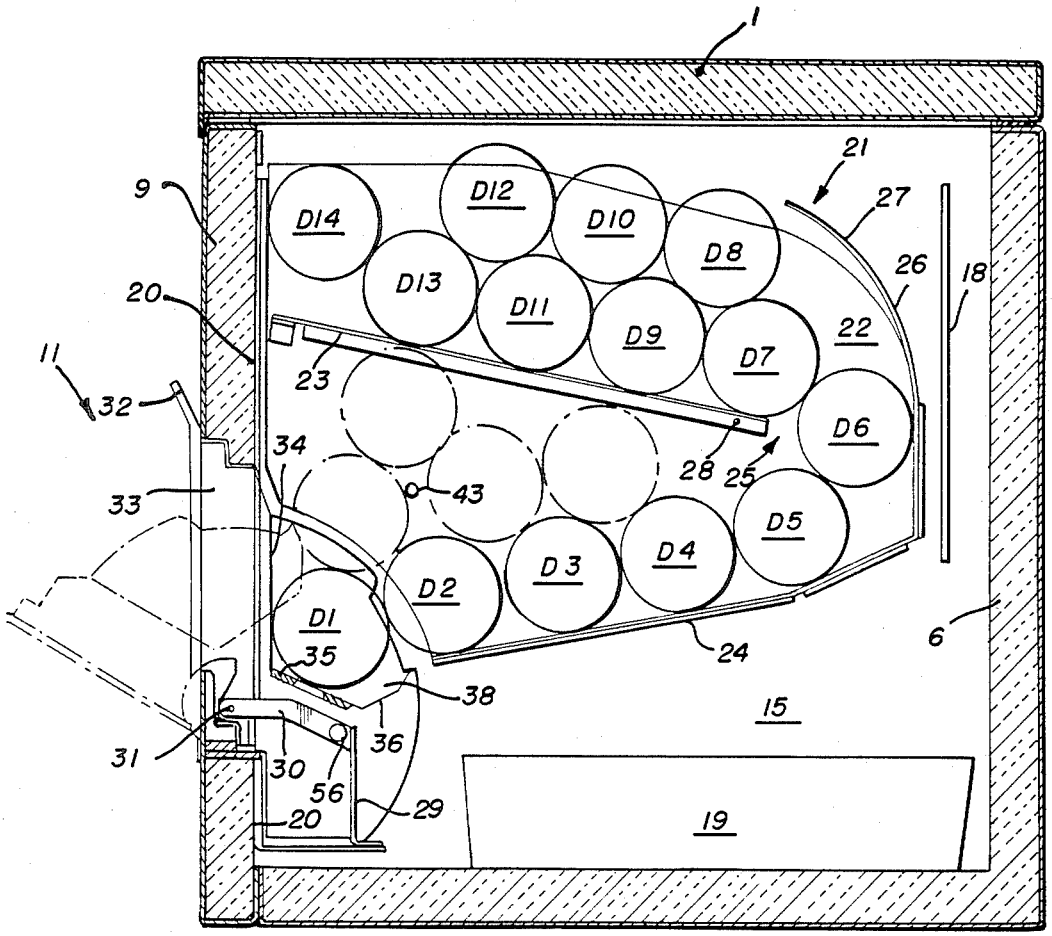
FIG. 3 (PRIOR ART)
FIG. 3 is a section taken along the line A—A of FIG. 2 and being illustrative of one of a plurality of vend baskets of the known prior art.

The chest has a front wall 9 and a door 10. In the front wall 9 are inset three outwardly pivotal dispensing lids 11, 12, and 13, including respective cradle assemblies, not shown. To these are attached placards indicating various product varieties. In the lower portion of the door 10 there is located a coin return opening and lies roughly beneath the coin slot 5 located in the cover plate 4. Behind the front wall 10 is a cooler compartment 15 which is shown in FIG. 3. The cooler compartment is thermally insulated on all sides. On the inside of the back wall 6 is an evaporator 18 of the cooling unit and on the floor of the cooling compartment 15 there is provided a drip pan 19.

A bearing plate 20 is attached to the inside of the front wall 9. The bearing plate 20 supports a vend chute in the form of a basket 21. The basket 21, for example, is operable to supply rollable products such as bottles or cans to the dispensing lid 11, shown in FIG. 1. Two other identical vend baskets, not shown, are associated with the other two dispensing lids 12 and 13.

The vend basket 21 shown in FIG. 3 constitutes a known prior art vend basket structure and is disclosed in the aforementioned U.S. Pat. No. 4,576,272. The vend basket 21 has a rearward slanting upward shelf 23 and a forward slanting lower shelf 24. At the rear of the basket is a passageway 25 having a width corresponding to the diameter of the cans D1 to D14. On the lower shelf 24, the cans D2 to D5 lie in a single tier; however, a double tier of cans may be loaded thereon as shown in the dotted lines by pivoting the upper shelf 23 about a hinge pin 28 located at the rear portion thereof and thus provides access to the lower shelf 24. On the upper support plate 23 in the position as shown in FIG. 3, the cans D7 to D14 lie in a double tier. In order to guide the cans of the upper tier to the passageway 25, a rear wall is provided having a curved upper portion 27.

A mechanical support bracket 29 is attached to bearing plate 20. The bracket has a hinge bracket 30 secured thereto for supporting a hinge rod 31 about which the lid 11 rotates. The lid 11 is shown in FIG. 3 in its closed position by continuous lines and in the open position by broken lines.

Figure 4:
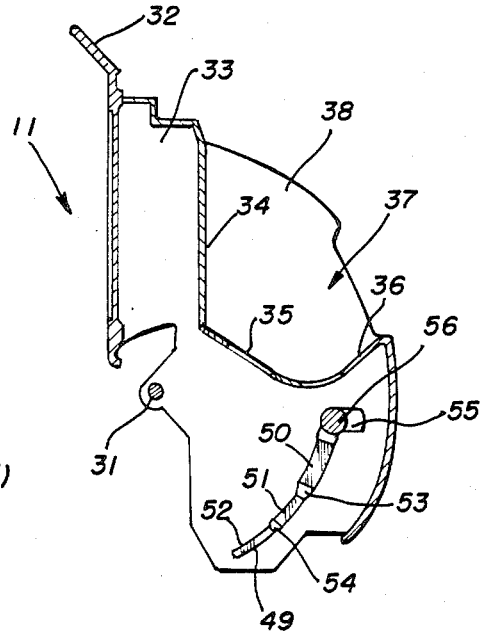
FIG. 4 (PRIOR ART)
FIG. 4 is a plan view of the inside surface of the left side wall of the dispensing lid and cradle shown in FIG. 3.

The lid 11 is shown in further detail in FIG. 4. In FIG. 4 the lid 11 is comprised of a pull plate 32 attached to an isolating component 33. The side of this, turned awawy from the plate 32, forms an inside surface piece 34 to which a pick up, base plate 35 turns into a roll-on surface 36 which forms thereby a cradle 37 for receiving a single article D1, for example, which has rolled into place from the lower shelf 24.

A vend cam 49 is further shown in FIG. 4, being attached to each side wall 38. The cam includes three steps 50, 51 and 52. An incline 53 leads from step 50 to 51 while an incline 54 leads from step 51 to 52. A cut out 55 is formed in the side wall 38 in front of the cam 49. A locking pin 56 is provided on the hinge bracket 30 and lies on a plane transverse to the lid structure. For further details, reference can be made to the aforementioned U.S. Pat. No. 4,576,272, which additionally discloses the details whereby articles are vended upon the insertion of one or more coins into the vending machine.

Figure 5:
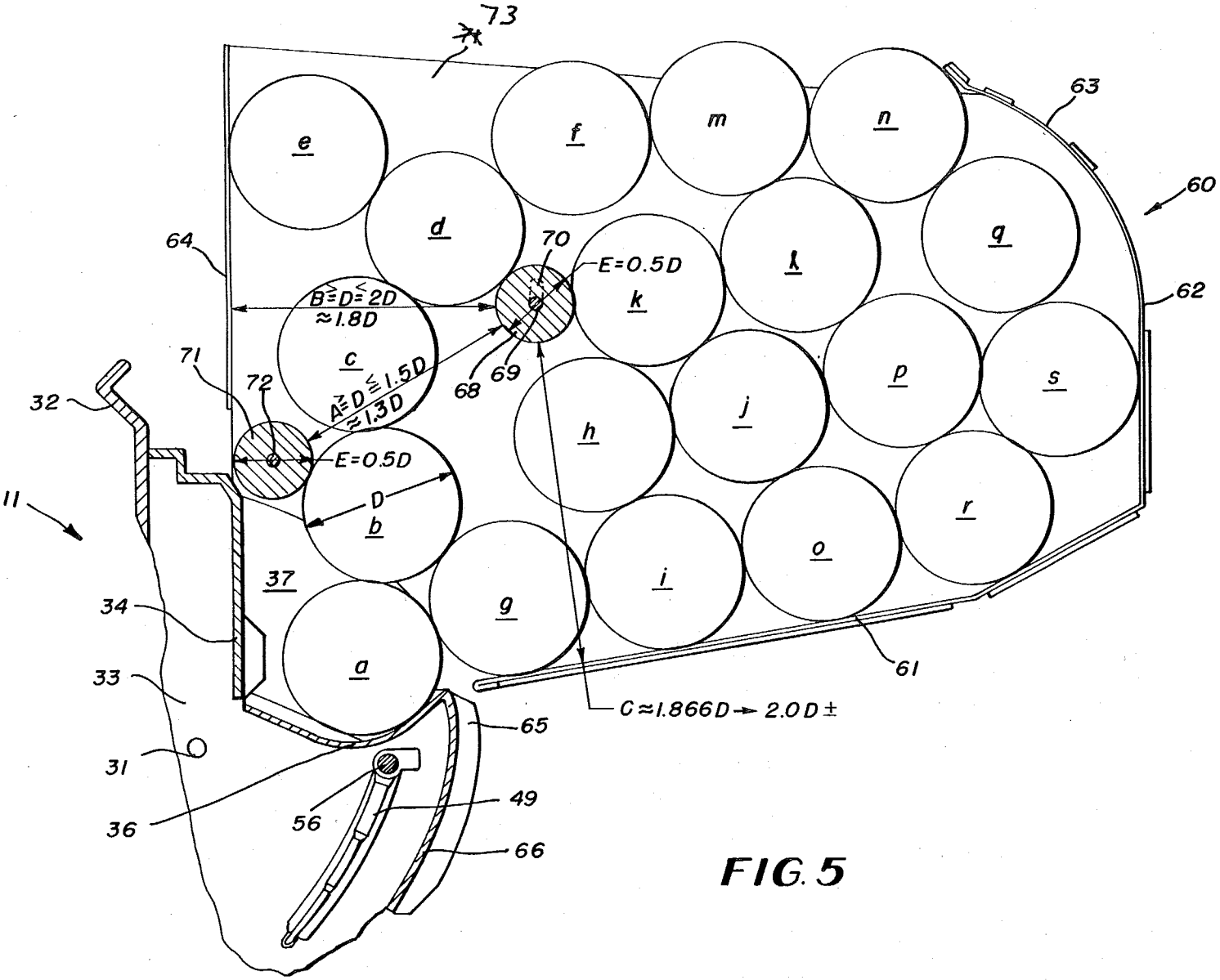
FIG. 5 is a partial central longitudinal view of the preferred embodiment of a vend basket in accordance with the present invention.

The present invention is directed to an improvement over the vending basket 21 shown in FIG. 3 by eliminating the upper roll-off ramp or shelf 23 in favor of a basket structure as shown in FIG. 5.

Referring now to FIG. 5, the preferred embodiment of the invention comprises an expanded capacity vend basket 60 which includes an inclined bottom shelf 61, a rear wall 62 having a curved upper portion 63 and a front wall 64. In this respect it is identical to the structure of the basket 21 shown in FIG. 3. The vend basket is capable of being filled with a number of cylindrical cans, for example nineteen, a to s which substantially fill all of the available spaces. The cans feed, one at a time, toward the dispensing lid 11 where they come to rest on the curved surface 36 of the cradle 37. As shown in FIG. 5, can a is in position to be dispensed upon rotation of the lid 11 about the pivot 31. As before, a multi-step release cam 49 is included in the lid structure.

Further as shown in FIG. 5, the lid 11 now further includes a curved blade type of extension 65 which is located on and extends outwardly from a forward arch lid segment 66 and has for its purpose the pushing back of any can, for example cans b and g shown in FIG. 5 when the lid 11 is rotated to dispense can a, for example, from the vending machine.

The vend basket 60 in accordance with the subject invention prevents jamming of the cans a . . . s being fed to the dispensing lid 11 by the inclusion of a first roller member 68 having a central shaft 69. Both the roller member 68 and shaft 69 extend across the width of the vend basket 60 where the shaft engages an elongated vertical slot 70 in each of a pair of side walls, one of which is shown in FIG. 5 by reference numeral 73. The rotational axis of the roller 68 is parallel to the rbtational axis of the cans a through s.

A second roller member 71 having a shaft 72 is mounted so that it also extends across the side walls 73 of the basket 60 and is located directly behind the front wall 64 adjacent the upper portion of the cradle section 37 of the lid 11.

The first or inner roller 68 is adapted to move vertically in the slot 70 due to the pressure of any can tending to urge it upwards from beneath during its travel to a dispensing lid 11. The second roller 71, however, is only permitted to rotate while being held in a fixed position. Both rollers 68 and 71 are of equal size having a diameter E which is approximately one-half the diameter D of the cans a . . . s, i.e. $E \approx 0.5D$.

The outer surfaces of the rollers 68 and 71, moreover, are spaced relative to one another by a predetermined distance A. The distance A is selected to be a dimension greater than the can diameter D but less than one and one-half times the diameter D, i.e. $D < A < 1.5D$. Preferably the distance A is approximately 1.3D. As a result, one can, for example can c can pass between the rollers 68 and 72. Additionally, the outer surface of the roller 68 is spaced from the inside surface of the front wall 64 by a distance B which is greater than one can diameter D, but less than two can diameters, i.e. $D < B < 2D$. Preferably the dimension B is such that $B \approx 1.8D$. The dimensions A and B permit one can to pass between the rollers 68 and 72; however, two cans cannot pass therebetween or can there be any jamming thereof.

The inner roller 68 is also spaced a distance C above the bottom shelf or roll-off ramp 61. The distance C is chosen such that two rows of cans closely stacked can pass under the roller 12. The distance C from the outer surface of the roller 68, when in its lowermost position, is greater than 1.866D. However, the length of the slot 70 is such that the distance C can be extended to slightly greater than 2D. Thus $C \geqq 1.866D \geqq 2D$. Accordingly, when the lid is rotated and the arched elements 65 and 66 rotate upwards, they push against the adjacent cans, typically cans g and b between the roller 68 and the lower shelf 61.

As shown in FIG. 5, can a can be removed when the dispensing lid 11 is opened. The roller 71 and the elements 65 and 66 of the lid 11 further prevent removal of a second can. The roller 68 holds back the cans d and k in contact therewith which in turn prop up the other cans e, f, m, l and n. Only when the rotatable lid 11 is closed far enough so that no can can be removed until the next can to be dispensed b falls onto the cradle 37, whereupon cans c to f move up. After removal of the cans b to f, the remaining cans are ready for dispensing.

Thus what has been shown and described is an improved vend basket which increases the holding capacity without causing the cans to jam against each other when they are being dispensed. Thus in its preferred embodiment, the first or inner roller 68 is mounted such that it can be raised a small distance vertically within the vend basket 60. This makes it possible such that when rotation of the dispensing lid 11 displaces cans adjacent thereto and impinge upon the roller 68, it makes an evading motion upwardly so that the cans do not jam between the roller 68 and the lower shelf 61 or the dispensing lid 11. With a second rotatable roller 71 in position below and forward of the roller 68, it is only possible that one can at a time can travel between the two rollers 68 and 71. The second roller 71 further insures that during the closing of a dispensing lid, a can always falls into place and cannot be reopened until a vending operation has been initiated by the deposit of a coin in payment for the article.

Having thus shown and described what is at present considered to be the preferred embodiment of the invention, it should be noted that the same has been made by way of illustration and not limitation. Accordingly, all modifications, alterations and changes coming within the spirit and scope of the invention are herein meant to be included.

What is claimed is:

1. An expanded capacity and non-jamming vend basket for a vending machine dispensing rollable products, such as bottles or cans, to an opening through a cabinet wall, comprising:

front and rear walls interconnected by a pair of side walls and further including a bottom shelf or wall inclined from rear to front toward said opening for feeding said rollable products one at a time, to said opening; and at least one roller member extending between said side walls and having a rotational axis parallel to the rotational axis of said rollable products, and being located a first predetermined distance from said front wall so that only one of said products can pass between said roller member and said front wall, and being further located a second predetermined distance from the bottom wall so that two rows of closely stacked products can fit and pass between said roller member and said bottom shelf.

2. The vend basket according to claim 1 wherein said rollable products are generally cylindrical and have a like diameter and wherein said first predetermined distance is equal to or greater than said diameter but less than twice said diameter.

3. The vend basket according to claim 1 wherein said at least one roller member has a diameter dimension less than said diameter of said rollable products.

4. The vend basket according to claim 1 wherein said at least one roller member has a diameter dimension which is approximately one-half said diameter of said rollable products.

5. The vend basket according to claim 1 wherein said rollable products have a like diameter and wherein said first predetermined distance is greater than said diameter but less than twice said diameter.

6. The vend basket according to claim 5 wherein said first predetermined distance is measured from the surface of said front wall to the surface of said at least one roller member.

7. The vend basket according to claim 6 wherein said at least one roller member has a diameter substantially equal to one-half said diameter of said rollable products.

8. The vend basket according to claim 1 wherein said at least one roller member is mounted in a pair of vertical slots respectively formed in said side walls for permitting said roller member to move vertically when urged by the upward movement of one or more of said rollable products in contact therewith.

9. The vend basket according to claim 1 wherein said rollable products have a like diameter and wherein said first predetermined distance comprises a distance greater than said diameter but less than twice said diameter and wherein said second predetermined distance comprises the distance at least equal to 1.866 times said diameter.

10. The vend basket according to claim 9 wherein said at least one roller member is movably mounted in a pair of slots in said side walls and wherein said second predetermined distance ranges between 1.866 times said diameter and 2.0 times said diameter.

11. The vend basket according to claim 1 and, further comprising another roller member extending between said side walls and having a rotational axis parallel to the rotational axis of said rollable products and being located directly behind said front wall adjacent said opening and being separated from said at least one roller member by a third predetermined distance.

12. The vend basket according to claim 11 wherein said rollable products are generally cylindrical and of like diameter and wherein said first predetermined distance is greater than said diameter but less than twice said diameter.

13. The vend basket according to claim 11 wherein said rollable products are generally cylindrical and of like diameter and wherein said first predetermined distance comprises a distance from the surface of said at least one roller member to said front wall and being aproximately equal to 1.8 times said diameter.

14. The vend basket according to claim 11 wherein said rollable products are generally cylindrical and of a like diameter and wherein said second predetermined distance is variable between 1.866 times said diameter and twice said diameter.

15. The vend basket according to claim 11 wherein said rollable products are generally cylindrical and of like diameter and wherein said third predetermined distance is greater than said diameter and less than one and one-half times said diameter.

16. The vend basket according to claim 15 wherein said third predetermined distance is approximately equal to 1.3 times said diameter as measured between the outside surfaces of said one and another roller members.

* * * * *

UNITED STATES PATENT AND TRADEMARK OFFICE

CERTIFICATE OF CORRECTION

PATENT NO. : 4,729,480

DATED : March 8, 1988

INVENTOR(S) : Groover et al.

It is certified that error appears in the above-identified patent and that said Letters Patent is hereby corrected as shown below: On the Title Page, Item [75] Inventors:

Please insert the name of "Bernd MEHLAN, Herrieden"

third-named inventor on the front of the patent

"both of" should read --all of--.

Signed and Sealed this

Twenty-seventh Day of December, 1988

*Attest:*

DONALD J. QUIGG

*Attesting Officer*

*Commissioner of Patents and Trademarks*